United States Patent [19]

Verachtert

[11] 4,199,440

[45] Apr. 22, 1980

[54] TRACE ACID REMOVAL IN THE PRETREATMENT OF PETROLEUM DISTILLATE

[75] Inventor: Thomas A. Verachtert, Wheeling, Ill.

[73] Assignee: UOP Inc., Des Plaines, Ill.

[21] Appl. No.: 936,427

[22] Filed: Aug. 24, 1978

Related U.S. Application Data

[63] Continuation-in-part of Ser. No. 794,153, May 5, 1977, abandoned.

[51] Int. Cl.[2] ..... C10G 25/12; C10G 19/02

[52] U.S. Cl. ..... 208/230; 208/263; 562/511

[58] Field of Search ..... 208/263, 283, 284, 285, 208/286, 206, 207, 203, 235, 230

[56] References Cited

U.S. PATENT DOCUMENTS

| | | | |
|---|---|---|---|
| 2,872,412 | 2/1959 | McNeill et al. | 208/203 |
| 2,988,500 | 6/1961 | Gleim et al. | 208/203 |
| 3,371,031 | 2/1968 | Strong | 208/206 |
| 4,019,869 | 4/1977 | Morris | 208/206 |
| 4,070,271 | 1/1978 | Carlson et al. | 208/206 |
| 4,070,307 | 1/1978 | Carlson | 208/206 |

*Primary Examiner*—George Crasanakis

*Attorney, Agent, or Firm*—James R. Hoatson, Jr.; Robert W. Welch; William H. Page, II

[57] ABSTRACT

An improved process is disclosed for removing trace acidic compounds from liquid hydrocarbons. Traces of acidic compounds, including carboxylic acids, $H_2S$, naphthenic acids, et al., are present in most hydrocarbon streams. The presence of these acidic compounds is considered deleterious to accepted product specifications. The trace acidic compounds which interfere are removed via injection of a dilute aqueous alkaline solution into the hydrocarbon stream and passage of this stream through a coalescing bed.

7 Claims, 1 Drawing Figure

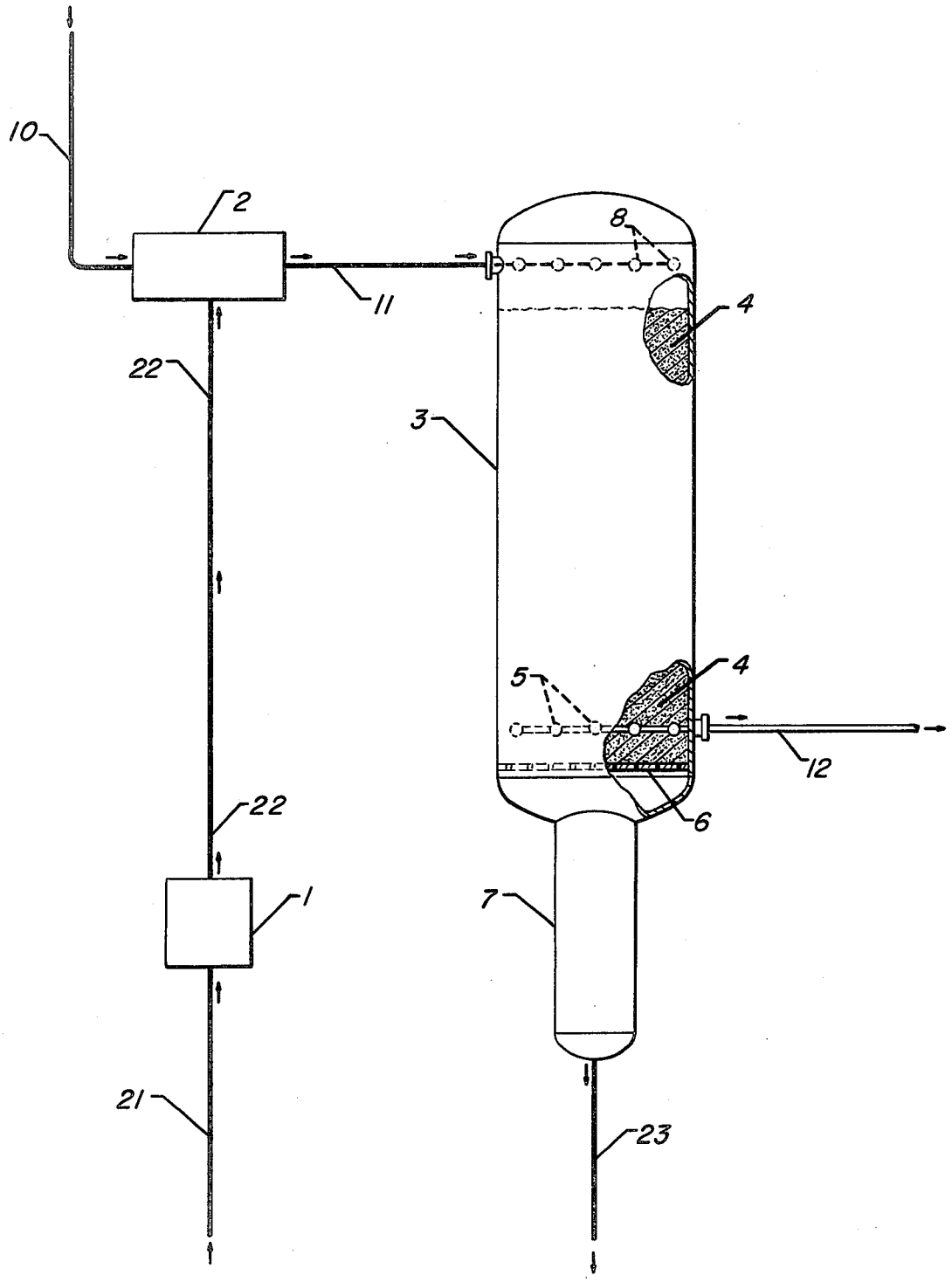
10
2
11
8
4
22
3
5
4
12
6
22
1
7
21
23

TRACE ACID REMOVAL IN THE PRETREATMENT OF PETROLEUM DISTILLATE

CROSS-REFERENCE TO RELATED APPLICATIONS

This application is a continuation-in-part of a copending application Ser. No. 794,153 filed May 5, 1977 and now abandoned.

Many hydrocarbons contain sulfur in the form of mercaptans (thiols). Mercaptans are almost invariably present in LPG, cracked gasolines, straight run gasolines, natural gasolines, and in heavier hydrocarbon distillates including e.g., kerosene and fuel oil.

These mercaptan components are objectionable mainly because of their strong odor, but also, in some cases, due to their objectionable chemical reaction with other hydrocarbons or fuel system components.

There have been many attempts to provide processes which would remove or convert mercaptans. Some of the earliest processes included treatment of the hydrocarbon fraction with caustic, clays, and hydrotreating. A significant improvement in the treating of hydrocarbon fractions was made when the UOP Merox Process was announced to the industry in 1959. The *Oil and Gas Journal,* in the Oct. 26, 1959 edition, contains a discussion of the Merox Process, and also of some prior art processes.

This process used a catalyst which was soluble in caustic, or alternatively held on a support, to oxidize mercaptans to disulfides in the presence of oxygen and caustic.

In U.S. Pat. No. 3,108,081, there is disclosed a catalyst comprising an adsorptive carrier and a phthalocyanine catalyst for the oxidation of mercaptans. The teachings of this patent are incorporated by reference. This patent taught that a particularly preferred phthalocyanine was the sulfonated derivative, with the monosulfonate being especially preferred.

In commercial operation, a number of catalyst poisons or other deleterious materials are present in the hydrocarbon feed to the processing units provided for mercaptan removal or conversion. Trace amounts of acidic components such as naphthenic acids and $H_2S$ are frequently encountered.

$H_2S$ is often naturally occurring but also present as a by-product of some earlier steps in processing wherein sulfur compounds, in the presence of hydrogen and high temperature, decompose to form $H_2S$. When the hydrocarbon feed stream being treated is either a naphtha or a kerosene, most of the $H_2S$ is removed by distillation; however, such removal is not always complete and further treatment of the hydrocarbon stream is required.

Naphthenic acids, and other carboxylic acids, are commonly found in crude oil. During distillation naphthenic acids are co-distilled with the hydrocarbons of similar boiling ranges concentrating in the various distillate streams. Naphthenic acids possess characteristics which permit solubility in both hydrocarbon and aqueous medium and are often referred to as surfactants because of their activity at surfaces such as the interface between a liquid hydrocarbon and water. When neutralized by alkaline salts, naphthenic acids form alkali naphthenates which are chemically similar to soaps. As such, they tend to emulsify hydrocarbon and aqueous phases interfering with efficient separation of oil and water phases. Because of these properties, they must be removed from finished products where aqueous emulsions are intolerable or from the feed to chemical treating processes where they interfere with efficient processing.

Accordingly, the treating arts have developed a number of ways of handling these problems. One way is to simply provide a large vessel, termed a pre-wash, partially filled with dilute aqueous caustic, disperse the hydrocarbon containing trace acidic components into the aqueous caustic, and pass the hydrocarbon stream up through the vessel. Typically the entering hydrocarbon stream will enter the pre-wash vessel through a series of nozzles to insure that there is intimate contact of hydrocarbon with dilute caustic. Sometimes contact is obtained by circulating the caustic inventory with a pump to mix the caustic with entering hydrocarbon in the piping. The strength and quantity of the caustic solution used are generally adjusted so that very little of the weakly acidic mercaptans in the feed are absorbed by the caustic. Only the more acidic naphthenic acids, $H_2S$ and other trace acidic compounds are removed by the caustic pretreatment. When very low acid contents in the product are required, the pre-wash vessel may be followed by a sand filter coalescer which will remove entrained droplets of aqueous salts from the hydrocarbon stream being treated. However, a sand filter requires frequent attention to maintain its coalescing efficiency and sand is subject to attack by aqueous basic solutions.

Unfortunately, such an operation does not always provide a satisfactory solution to the problem of removing acids. Use of a large pre-wash vessel adds to the capital expense of the plant and may not provide efficient utilization of the caustic solution. In the case of naphthenic acid removal, very dilute caustic solutions must be employed otherwise serious emulsion formation will be encountered and this will require expensive emulsion breaking techniques. Use of a batch pre-wash system also means that the efficiency of naphthenic acid removal is cyclical. The efficiency is typically greatest when the caustic is fresh, and lowest just before the weak caustic is discarded. Because of the batch nature of the process, and because of the surfactant nature of naphthenate soaps, a certain amount of unneutralized caustic is always discarded with the spent caustic.

Even with use of a conventional coalescer following the pre-wash vessel, e.g., sand filter or mesh blanket coalescer, the entrainment of acidic salts is still sometimes excessive. This is because the efficiency of coalescers is dependent on many factors. Reasonable efficiency can only be obtained within a relatively narrow velocity range and deterioration in efficiency with use is common as particulate buildup, sand attrition, channeling, and other factors cause deterioration in performance. The inability of the conventional coalescers to maintain high efficiencies without frequent maintenance has lead to the use of electrical coalescers. These devices are similar to the well known desalters used on crude petroleum to remove entrained water containing dissolved salts. With the use of an electrical coalescer, it is possible to remove enough of the entrained caustic containing the naphthenic acid salts from a pre-washed hydrocarbon to satisfy the requirements of downstream processing units and, where applicable, such specifications as water separation from jet fuel for example. Unfortunately, the electric coalescers are proprietary items and add greatly to the expense of pretreatment equipment. They also require careful attention increasing the utilities cost and operator expense.

Another problem experienced by the prior art pre-wash processes is disposal of large quantities of partially spent reagent. As previously mentioned, efficient emulsion-free operation of the batch type pre-wash vessel precludes total exhaustion of the alkali solution. Beyond about 40% utilization of the caustic emulsion formation is encountered even when using dilute caustic solution. Thus, there is always a significant amount of unneutralized caustic remaining in the relatively large liquid reserve of alkali solution in the pre-wash vessel. Thus, when the efficiency of acid removal by the alkaline solution is no longer satisfactory, a high percentage of unneutralized alkali is unavoidably discarded. This is a problem, not only because of inefficient use of reagents, but because the free alkali represents a disposal problem.

Another disadvantage of a batch pre-wash is that the naphthenic acids present in the spent caustic phase are difficult to recover. If an attempt is made to recover these acids, it is first necessary to acidify the spent caustic to liberate the acids, and then separate acids from admixed neutral oil. Because of the dilute nature of the streams used in a pre-wash upstream of a mercaptan conversion process, the recovery of naphthenic acids is usually considered not worthwhile. Thus, a source of potentially valuable raw material is lost. Naphthenic acids can be used as drying oils, wood preservatives, and to some extent in extreme pressure lubricants. The naphthenic acids have also been used as solvents for vulcanized rubber, various resins and gums, for aniline dyes, as clarifying agents for mineral oil, as insecticides, and as additives to wood oil to permit drying without cracking.

Consequently, refiners continue to search for a process which would provide for efficient acid removal, be economical to operate, and provide near stoichiometric utilization of the alkali solution. There is also a need for a process which would be continuous to avoid the necessity of frequent draining and handling of large volumes of alkali solution.

The present invention embodies an improvement in a process for the oxidation of mercaptans contained in a sour petroleum distillate which comprises pretreating said distillate for the separation of naphthenic acids by (a) admixing said distillate with an aqueous base solution containing from about 100 to about 200% of the stoichiometric amount of base required to neutralize the naphthenic acid concentration of said distillate; (b) passing the mixture through a fixed bed of charcoal particles at a liquid hourly space velocity of from about 0.5 to about 20 and coalescing the aqueous phase of said mixture therein, said fixed bed having a media particle size distribution of from about 0.1 to about 6 mm; (c) recovering the mercaptan-containing sour petroleum distillate from a lower portion of said charcoal bed substantially free of naphthenic acids; and (d) withdrawing the coalesced aqueous phase from the bottom of said charcoal bed.

One of the more specific embodiments relates to an improvement in a process for the oxidation of mercaptans contained in a sour petroleum distillate which comprises (a) admixing said distillate with from about a 1 to about a 3 wt. % aqueous sodium hydroxide solution containing from about 100 to about 120% of the stoichiometric amount of sodium hydroxide required to neutralize the naphthenic acid concentration of said distillate; (b) passing the mixture through a fixed bed of charcoal particles at a liquid hourly space velocity of from about 0.5 to about 20 and coalescing the aqueous phase of said mixture therein, said fixed bed having a media particle size distribution of from about 0.1 to about 2 mm; (c) receiving the mercaptan-containing sour petroleum distillate from a lower portion of said charcoal bed substantially free of naphthenic acids; and (d) withdrawing the coalesced aqueous phase from the bottom of said charcoal bed.

In another embodiment, this invention provides a process for the recovery of naphthenic acids from a liquid hydrocarbon which comprises (a) admixing said hydrocarbon with an aqueous base solution and neutralizing said naphthenic acids; (b) passing the mixture through a fixed bed of charcoal particles, coalescing the aqueous phase of said mixture therein, and adsorbing at least a portion of the neutralized naphthenic acids on said charcoal particles, said fixed bed having a media particle size distribution of from about 0.1 to about 6 mm; (c) separating and coalescing said aqueous phase comprising the spent base solution, and recovering a hydrocarbon phase depleted in naphthenic acids; and (d) recovering the neutralized naphthenic acids from said charcoal particles by treating said particles with high pressure steam to volatize said neutralized acids.

The hydrocarbon streams which may be treated in the process of the present invention are those containing any trace amount of acid. For example, naphthenic acids are usually found in streams with ASTM D 86 end points in excess of 150° C. $H_2S$ can be found in most refinery intermediate product streams. Carboxylic acids are often present in catalytically cracked stocks. The method of the present invention can be applied with great success to all of these stocks.

Many kerosene charge stocks which must be treated for mercaptan conversion frequently contain high naphthenic acid concentrations. The naphthenic acid content is generally indicated by acid number, with typical units being milligrams of KOH required to neutralize the acid in one gram of sample. The product specification for most jet fuels sets the maximum acid number at 0.010 mg KOH/g. Charge stocks are being encountered today which have acid numbers in excess of 0.100 mg KOH/g. The existing batch type pre-wash units followed by a coalescer cannot efficiently remove naphthenic acids in a range above about 0.025 mg KOH/g. The presence of such large amounts of naphthenic acids in the feed to a mercaptan conversion unit, if not removed, would result in operating difficulties with the treating unit and loss of product. The acid number of a kerosene or other hydrocarbon can be determined by any of several methods of test such as ASTM-D-3242, ASTM-D-3339, ASTM-D-974, ASTM-D-664, etc.

The aqueous base suggested for use may be any inorganic base soluble in aqueous (or alcoholic) solvent. Both NaOH and KOH are suitable, with NaOH being preferred because of its availability and low cost. A relatively dilute aqueous base is required to effect solubility of the naphthenic acid in the aqueous phase without encountering the emulsion formation that results when concentrated aqueous base is used. Solubility of the alkali naphthenates in the aqueous phase decreases as the concentration of alkali in the aqueous phase increases. Solubilities of other acid salts also limit the concentration of base in the solution that may be practically used at normal temperatures.

Regardless of the type or concentration of the base used, the present invention permits operation with only a slight excess of base to allow for variation in acid concentration of the feed stock.

The feed stream and the aqueous alkali phase are contacted in a simple mixing device before entering the coalescing bed.

The coalescing bed is selected from the group of substrates which are not attacked by alkali, such as various activated charcoals, coal, lignite, shale, calcined coke, etc., preferably with hydrophillic properties. Examples of suitable charcoals include those derived from ground wood pulp, lignite coal, anthracite coal, bituminous coal, peat, petroleum black, and similar charcoals. Especially preferred is ground and graded anthracite coal.

The contact of hydrocarbon with injected alkali and the coalescing bed may occur in any suitable manner. The coalescing medium may be maintained as a fixed or moving bed. Batch contacting may also be employed. The stream may pass over the coalescing medium in upflow, downflow or radial flow.

The amount of coalescing media provided must be adjusted to conform to the properties of the feed and to the desired properties of the product. It may be desirable to provide parallel coalescing beds so that one bed can be used while another is being regenerated. Series flow to promote maximum removal of acids can also be used. Use of multiple beds in series flow with a parallel train is also possible.

The amount of coalescing media required may be specified as a function of liquid flow rate. In general, enough coalescing media should be provided so that the liquid hourly space velocity will be in the range of 0.5 to 20. Similarly, the geometry of the preferred fixed bed of catalyst is such that the superficial liquid velocity through the bed is chosen to provide the highest efficiency and lowest cost.

For best results, the media particle size distribution should be in a range of 0.1 millimeters to 6.0 millimeters with particle sizes in a range of 0.6 to 2.0 mm exhibiting excellent properties.

The conditions of temperature and pressure at which the aqueous base contacts the feed, and in which the mixture contacts the coalescing media are not critical. In general ambient temperatures which are above the freeze point of the aqueous phase or the pour point of the oil phase can be used. The typical rundown temperatures of refinery hydrocarbon product streams are 10° to 60° C., and the present invention works well within these temperature ranges. The lower limit on temperature is usually set by the temperature at which the viscosity of the fluid becomes so great that good contacting of aqueous phase and fresh feed is precluded, and subsequent separation of aqueous phase from organic phase is hindered. The upper limit of temperature is usually set by the degree of dehydration that can be tolerated in the system and the allowable water content of the treated hydrocarbon stream. Operation at temperatures of 25° to 60° C. gives satisfactory results with many feed streams. The normal materials are very fluid at these temperatures, and contact and separation of aqueous and hydrocarbon phases is facilitated. Operation at much higher temperatures is possible, and may be desirable in the case of very heavy or viscous oils which must be treated. Higher temperatures promote contacting and rate of reaction, but adequate acid removal, for example, can usually be obtained without the expense of heating the stream to high temperature. The pressure under which the acid removal process of the present invention operates should be sufficient to maintain liquid phase operation as both the contact and separation of organic and aqueous phases occur entirely in liquid phase. Pressure is not believed to be a significant variable. Accordingly, the pressure will generally be the least amount of pressure required to get the fluids through the processing units.

The function of the caustic injection is twofold. Not only does the caustic neutralize the acid in the feed, it also wets the surface of the bed of coalescing media. Thus, the process of the present invention works efficiently because acids and caustic react not only in the mixing devices upstream of the coalescing bed, but also in the coalescing bed. It is because of this extensive and efficient contact of caustic and acid that the present invention works so efficiently.

There is still an aqueous phase dispersed in the hydrocarbon stream after reaction of acid and alkali is complete. This aqueous phase must be removed. This is another function of the coalescing bed. The dispersed aqueous phase is gradually coalesced into larger droplets by the bed finally forming large drops which separate and gravitate to the bottom of the coalescing vessel for removal. Preferably a level controller automatically drains the aqueous phase from the coalescing vessel as it accumulates. The advantage of the automatic level control is that it makes the process truly continuous requiring little or no operator attention.

The charcoal bed is preferably supported by a flat screen which will hold up the charcoal but allow the spent aqueous base to pass therethrough for removal from the bed. Especially preferred are the well known Johnson screens available from the Johnson Division of UOP Inc. These screens consist of wedge shape rods welded onto a support. They are very strong and generally non-clogging, and provide a relatively large open area for fluid flow. The hydrocarbon stream may be added to and removed from the charcoal bed via cylindrical screens of the same type of construction.

BRIEF DESCRIPTION OF THE DRAWING

The drawing shows a simplified, schematic flow diagram of one embodiment of the present invention wherein a dilute alkali solution is continuously injected into an acid bearing feed and the mixture passed through a coalescing bed.

DETAILED DESCRIPTION

In the first step of the process of the present invention, an acid bearing feed stream in line 10 is contacted with a dilute aqueous base from storage tanks (not shown) charged by metering pump 1 taking suction via line 21 and discharging via line 22. Caustic is charged to mixing device 2. The mixture of feed and base is charged via line 11 to the coalescing vessel 3. Coalescing vessel 3 consists of coalescing bed 4, inlet distributor 8, collector pipe 5, and drain screen 6.

Treated hydrocarbon, substantially free of acids, is removed from the charcoal bed via collector pipe 5 and product line 12, then charged to other processing units or storage (not shown).

The aqueous phase coalesced by the charcoal bed trickles down through the coalescing bed exiting via drain screen 6, into drain pot 7. Sight glass and level control means (not shown) provide for the continuous withdrawal of spent aqueous phase via line 23.

EXAMPLE I

A miniature pilot plant was used to test this invention. The feed was a kerosene with an extremely high acid number of 0.084 mg KOH/g. The coalescing bed consisted of 50 cc of charcoal made by the Norit Co. The charcoal was designated as 10/30 mesh, and 90% of it had a particle diameter between 0.6 and 2.0 mm. The charcoal was disposed as a fixed bed in a small pressure vessel. The internal diameter of the vessel was 25 mm and the height of the bed was 100 mm. The charcoal was supported at the bottom by a plug of glass wool. The alkali solution added to neutralize the naphthenic acids was a dilute aqueous solution of NaOH. The caustic strength was 1.5 wt. %. The base was added by slowly closing a hypodermic syringe. Such a method of adding caustic was necessary because the plant was small and because the present invention makes very efficient use of caustic. An ultrasonic mixer was used to mix the kerosene with the NaOH upstream of the coalescing bed.

The feed was tested for acid number. The hydrocarbon product, after passage through the bed of activated charcoal, was analyzed for both sodium content and acid number. The feed, after mixing with caustic, but before coalescing, was measured to confirm the calculated addition of NaOH. Both acid titration and atomic absorption spectroscopy analyses of the mixture were used to determine alkali content.

Tests were run at 2.0 and a 4.0 LHSV, i.e., a charge rate of 100 cc/hr and 200 cc/hr, respectively.

The experimental results are reported in the following Table 1.

Table 1

| Hours | LHSV | Product Acid No. | NA (ppm) | Moles Added | NaOH/Mole Titration | Acid in Feed: AAS |
|---|---|---|---|---|---|---|
| 0–8 | 2 | 0.001 | 0.25 | | | |
| 8–17 | 2 | 0.010 | | 1.11 | 0.46 | |
| 17–38 | 2 | 0.011 | | | | |
| 38–73 | 4 | 0.029 | 1.5 | 1.77 | 1.29 | 0.27 |
| 73–80 | 4 | 0.009 | 0.34 | 1.26 | 0.60 | 0.10 |
| 80–100 | 4 | 0.004 | 0.45 | 1.28 | 1.29 | 0.10 |
| 100–124 | 4 | 0.023 | 2.2 | 1.14 | 0.60 | 0.34 |
| 124–152 | 4 | 0.005 | 3.6 | 1.14 | 0.58 | 0.77 |
| 152–179 | 4 | 0.018 | 8.1 | 1.14 | 0.40 | 0.74 |
| 179–197 | 4 | 0.036 | 19 | 1.14 | 0.48 | 1.03 |
| 197–221 | 4 | 0.006 | 3.6 | 1.14 | 0.34 | 0.53 |
| 221–248 | 4 | 0.004 | 7.1 | — | — | 0.80 |
| 248–273½ | 4 | 0.003 | 6.1 | — | — | 0.74 |

EXAMPLE II

Another test was made of this invention in a commercially sized unit. The charge stocks used were kerosenes derived from Louisiana and from Illinois. The unit used an existing refinery vessel as a coalescing bed. No attempt was made to design the vessel beforehand, rather an attempt was made to use the equipment existing at the plant to try out this invention on a slightly larger scale.

No mixing device was readily available to permit intimate contacting of the kerosene feed with the alkaline medium. As a substitute, a valve was pinched partially shut upstream of the coalescer.

The alkaline medium used was caustic available in the refinery, which had a concentration of 4°–6° Baume. This concentration was higher than desired but was the only strength obtainable for the experiment. Calculations indicated that approximately three gallons per hour of caustic injection was necessary to neutralize the kerosene derived from the Louisiana crude, while 1.5 gallons per hour caustic was required for neutralization of acids contained in the kerosene derived from the Illinois basin material. The coalescing medium used was Calgon SGL charcoal, 8×30 mesh. Caustic injection, using the Louisiana crude, was begun at a rate of 10 gallons per hour, or considerably in excess of that required by stoichiometry to neutralize acids, primarily naphthenic acids. This caustic injection rate reduced the initial acid number of the kerosene from 0.10 mg KOH/g to 0.0096 mg KOH/g. The resulting drained caustic was only about 50% spent. Caustic injection was further decreased to about 7.6 gallons per hour, but this resulted in inadequate acid removal. The kerosene product by analysis contained an unacceptably high naphthenic acid content, 0.032 mg KOH/100 ml. This analysis might be questioned due to difficulty in obtaining a representative sample. The drained caustic was 60% spent, however. The amount of caustic which remained entrained in the product kerosene ranged from 0.042 to 0.067 ppm NaOH. This lower caustic entrainment was expected, because from my experience it is easier to separate caustic from hydrocarbons in a commercially sized unit than in a pilot plant.

EXAMPLE III

Further tests were then run in the pilot plant facility described in Example I. These tests were run with charcoal obtained from the Darco Company which had a nominal size of 10–30 mesh (90% of the particles had a diameter between 0.6 and 2.0 milliliters). The charge stock used was identical to that used in Example I. In Example III the target amount of caustic injected was 1.2 times that theoretically required to neutralize naphthenic acids. The caustic material used was slightly more concentrated than that used in the first experiment, namely 5° Baume NaOH (equivalent to 3.2 wt. % NaOH). The reactor temperature was 78° F., the reactor pressure was 80 psig.

The test results are reported in Table 2.

Table 2

| Hours | LHSV | Product Acid No. | Na (ppm) | *PPM NaOH Added Addition | Titration |
|---|---|---|---|---|---|
| 0–12 | 4 | 0.005 | — | 73 | 18 |
| 12–23 | 4 | 0.017 | | 73 | 16 |
| 23–37 | 4 | 0.010 | 1.2 | 73 | 22 |
| 37–45 | 4 | 0.007 | 1.4 | (Temporary Haziness in Product) | |
| 45–53 | 4 | 0.005 | | 73 | 32 |
| 53–64 | 4 | 0.016 | | (Jelly Appearing | |

Table 2-continued

| Hours | LHSV | Product Acid No. | Product Na (ppm) | *PPM NaOH Added Addition | *PPM NaOH Added Titration |
|---|---|---|---|---|---|
| | | | | in Separator) | |
| 64-73 | 4 | 0.009 | | 75 | 20 |
| 73-80 | 4 | 0.006 | | 75 | 19 |
| 80-89 | 4 | 0.005 | | — | — |
| 89-99 | 4 | 0.005 | | 75 | 45 |
| 99-108 | 4 | 0.003 | | 75 | 64 |
| 108-118 | 4 | 0.005 | | 75 | 11 |
| 118-126 | 4 | 0.008 | | — | — |
| 126-137 | 4 | 0.023 | | 73 | 15 |
| 137-150 | 4 | 0.010 | 2.8 | 73 | 13 |
| 150-159 | 4 | 0.007 | | 73 | 19 |
| 159-166 | 4 | 0.005 | | 71 | 68 |
| 166-189 | 4 | 0.006 | | 71 | 11 |
| 189-196 | 10 | 0.012 | 2.5 | 69 | 78 |
| 196-204 | 10 | 0.011 | 12.9 | 68 | 39 |

*NOTE: 62 ppm NaOH required by stoichiometry

A gel like substance appeared in the separator after 64 hours of operation and continued to be produced for the remainder of the experiment. A temporary plug developed at 99 hours into the experiment. From time to time some temporary haziness would appear in the product but this would usually go away after several hours. The hazy product at the end of the run, however, required a standing period of up to 7 days to clear. It is believed that the higher concentration of NaOH caused the production of the gel-like substance indicating the need to adjust the caustic concentration carefully.

EXAMPLE IV

The same test apparatus and charge stock was used as in Examples I and III. In this example the coalescing material used was ground anthracite coal. The nominal particle size of the coal was 0.84 to 2.0 mm, also designated as 10×20 mesh.

A slightly more dilute caustic was used in this experiment, namely 3° Baume NaOH (equivalent to 1.8 wt. % NaOH). The experiment was conducted at a 4.0 LHSV, and continued until supplies of feed stock were exhausted. The experimental results are reported on Table 3.

Table 3

| Hours | LHSV | Product Acid No. | Product Na (ppm) | PPM NaOH Addition | PPM NaOH Titration |
|---|---|---|---|---|---|
| 0-11 | 4 | 0.046 | — | 68 | — |
| 11-23 | 4 | 0.014 | 3.9 | 68 | 12 |
| 23-35 | 4 | 0.008 | — | — | 8 |
| 35-48 | 4 | 0.007 | 1.9 | 67 | 31 |
| 48-70 | 4 | 0.005 | 0.63 | 67 | 60 |
| 70-89 | 4 | 0.006 | 0.50 | 67 | 23 |
| 89-97 | 4 | 0.005 | — | 67 | 28 |
| 97-120 | 4 | 0.004 | 0.92 | 67 | 31 |
| 120-144 | 4 | 0.006 | 0.66 | 67 | 40 |
| 144-168 | 4 | 0.006 | 1.05 | 67 | 36 |
| 168-175 | 4 | 0.006 | — | 67 | 35 |

This experiment was generally more successful in lowering the naphthenic acid content of the product, as indicated by the acid number thereof. This experiment was also very satisfactory in that the sodium content of the product was significantly lower than that indicated in earlier examples, although the sodium content of the product of Examples I and III is satisfactory.

Most of the improvement in Example IV is due to the lowered NaOH concentrations but there is perhaps a synergistic effect due to the use of anthracite as coalescing medium.

The coalescing bed of the present invention when used for removal of naphthenic acids may eventually become saturated with naphthenic acid salts. To permit reactivation of the bed, and also to permit recovery of the naphthenic acid salts for use as a valuable by-product, a number of regeneration procedures can be used.

It is believed that a reasonable regeneration can be performed by merely removing the bed from the flow stream and passing hot steam over the bed. To provide a more complete regeneration of the bed, and to permit recovery of the naphthenic acid salts in the form of the acid rather than the salt, it would be also possible to re-acidify the salts in situ. This may be accomplished by isolating the coalescing bed from the hydrocarbon and aqueous streams, circulating an aqueous, acidic solution over the bed, and desorbing the naphthenic acids from the charcoal. If a sufficient quantity of acidic water is used, much of the naphthenic acids will be displaced in the acidification step. The desorption of naphthenic acids may be promoted by passage of hot steam over the reactor. The naphthenic acids are volatile with steam and this procedure should provide for almost complete regeneration of the coalescing bed. If the charcoal bed is not readily regenerable with these mild techniques it may be necessary to go to higher temperature steam treatment, or treatment with various well-known hydrocarbon solvents such as benzene, acetone and methanol mixtures to assist in removal of naphthenic acids and acid salts from the coalescing bed.

One of the interesting features of this invention is that while doing an excellent job of removing acids in the kerosene product or for feed to a mercaptan conversion unit, it also produces as much as a 1000 fold increase in the concentration of naphthenic acids, permitting the possible recovery of naphthenic acids where they are a desired by-product, and simplifying the disposal of these compounds where there is no market for them. Most of the naphthenic acids will be recovered in the aqueous phase once an equilibrium amount has accumulated on the coalescing bed.

The present invention may also be used to remove $H_2S$ from hydrocarbon streams. A hydrocarbon stream containing, e.g., 0.01 wt. % $H_2S$ may be contacted with an aqueous 6 wt. % NaOH stream and passed downward concurrently through a coalescing bed. The coalescing bed preferably comprises a charcoal having a nominal granulation range of 0.6 to 2.0 millimeters available under the trade name of Calgon. Utilizing 30 percent excess base, the hydrocarbon product from the coalescer should contain less than 0.0005 wt. % $H_2S$.

The efficiency of removal of certain acids is limited by equilibrium considerations at the operating conditions desired. Partial removal of very weak acids, e.g., mercaptans and phenols, is also possible subject to equilibrium considerations, adjustment of base concentration, and dependent on the specific acidic component being removed.

It is preferred to use more concentrated base for removal of $H_2S$ than for removal of naphthenic acids. This is because salts of $H_2S$ are more soluble than salts of naphthenic acids. NaOH concentrations of 2 to 10 wt. % will give good results.

As applied to removal of naphthenic acids, the data indicate that the process of the present invention is very effective in reducing the acid number of a kerosene severely contaminated with naphthenic acid. In general, the naphthenic acid content could be reduced to acceptable levels for further processing or sale.

It can be seen that the method of the present invention provides for nearly stoichiometric utilization of the caustic. There is also more effective acid neutralization because of the larger effective surface area of basic medium, not only in the mixing means, and piping, but also in the coalescing bed. There is greater flexibility and efficiency permitting operation with hydrocarbon flow rates much less than normal. There is negligible entrainment of aqueous solution with hydrocarbon because of the ability of the coalescing bed to coalesce aqueous droplets into a separate phase that will separate by gravity, from the hydrocarbon. There is also afforded a reduction in cost of pretreatment facilities.

I claim as my invention:

1. A process for the pretreatment of a sour petroleum distillate before said distillate is treated to effect the oxidation of the mercaptans contained therein, said pretreatment being performed on said distillate to neutralize acid concentrations of naphthenic acids, carboxylic acids and hydrogen sulfide which comprises:

(a) admixing said distillate with an aqueous base solution containing from about 100 to about 200% of the stoichiometric amount of base required to neutralize the acidic concentration of said distillate;

(b) passing said admixture through a fixed bed consisting of charcoal particles having a particle size distribution of from about 0.6 to about 2 mm. under non-oxidation conditions at a liquid hourly space velocity of from about 0.5 to about 20 and coalescing said aqueous phase of said admixture;

(c) recovering said sour petroleum distillate without the presence of any oxidation products from step (b) and substantially free of said acidic contaminants from the lower portion of said charcoal bed; and (d) withdrawing said coalesced aqueous phase from the bottom of said charcoal bed.

2. The process of claim 1 further characterized with respect to step (a) in that said aqueous base solution contains from about 100 to about 120% of the stoichiometric amount of base required to neutralize the acid concentration of said distillate.

3. The process of claim 1 further characterized with respect to step (b) in that said charcoal is a charcoal derived from the group consisting of ground wood pulp, lignite coal, anthracite coal, bituminous coal, peat and petroleum black.

4. The process of claim 1 further characterized with respect to step (a) in that said aqueous base solution is from about a 1 to about a 3 wt. % aqueous sodium hydroxide solution.

5. The process of claim 1 further characterized in that said neutralized naphthenic acids adsorbed on said charcoal particles are recovered by treating said particles with high pressure steam to volatize said naphthenic acids.

6. The process of claim 1 further characterized in that said neutralized naphthenic acids adsorbed on said charcoal particles are recovered by treating said particles with an acid medium, and subsequently displacing the resulting naphthenic acids from said particles with a desorbent.

7. The process of claim 1 further characterized in that said neutralized naphthenic acids adsorbed on said charcoal particles are recovered by treating said particles with an acid medium, and subsequently displacing the resulting naphthenic acids from said particles with from about 200° to about 400° C. steam.

* * * * *